US005310262A

United States Patent [19]

Robison et al.

[11] Patent Number: 5,310,262

[45] Date of Patent: May 10, 1994

[54] FLEXIBLE PACKAGE WITH AN EASY OPEN ARRANGEMENT

[75] Inventors: Lyle D. Robison, Sheboygan, Wis.; Robert C. James, Bonita Springs, Fla.

[73] Assignee: Bemis Company, Inc., Minneapolis, Minn.

[21] Appl. No.: 892,219

[22] Filed: Jun. 2, 1992

[51] Int. Cl.[5] ..... B65D 33/16

[52] U.S. Cl. ..... 383/205; 383/66; 383/113

[58] Field of Search ..... 383/66, 205, 113

[56] References Cited

U.S. PATENT DOCUMENTS

| | | | |
|---|---|---|---|
| 2,952,395 | 9/1960 | Spees | 383/205 |
| 2,991,000 | 7/1961 | Spees | 383/205 |
| 3,056,492 | 10/1962 | Campbell | 383/113 |
| 3,266,710 | 8/1966 | Reeves | 383/113 |
| 3,287,878 | 11/1966 | Mobley . | |
| 3,552,631 | 1/1971 | Fuchs . | |
| 3,681,890 | 8/1972 | Pringle, Jr. et al. . | |
| 3,711,011 | 1/1973 | Kugler . | |
| 3,910,488 | 10/1975 | Goodrich . | |
| 3,977,591 | 8/1976 | Martensson et al. . | |
| 4,088,264 | 5/1978 | Vogt . | |
| 4,363,841 | 12/1982 | Snow | 383/113 |
| 4,372,460 | 2/1983 | Brochman et al. . | |
| 4,373,978 | 2/1983 | Patterson . | |
| 4,378,074 | 3/1983 | Brochman . | |
| 4,420,080 | 12/1983 | Nakamura | 383/66 |
| 4,457,960 | 7/1984 | Newsome | 383/113 |
| 4,483,445 | 11/1984 | Lepisto et al. . | |
| 4,500,011 | 2/1985 | Brochman . | |
| 4,522,269 | 11/1985 | Chang | 383/66 |
| 4,522,305 | 6/1985 | Jacobsson . | |
| 4,577,761 | 3/1986 | Nadaskay . | |
| 4,585,498 | 4/1986 | Lagerstedt et al. . | |
| 4,595,116 | 6/1986 | Carlsson . | |
| 4,610,357 | 9/1986 | Nakamura | 383/66 |
| 4,651,874 | 3/1987 | Nakamura | 383/66 |
| 4,705,197 | 10/1987 | Gordon et al. . | |
| 4,739,879 | 4/1988 | Nakamura | 383/66 |
| 4,792,069 | 12/1988 | Nantin et al. . | |
| 4,798,296 | 1/1989 | Lagerstedt et al. . | |
| 4,834,245 | 5/1989 | Ohga et al. . | |
| 4,840,270 | 6/1989 | Caputo et al. | 383/66 |
| 4,848,575 | 7/1989 | Nakamura et al. | 383/66 |
| 4,896,788 | 1/1990 | Bolte et al. . | |
| 4,953,708 | 9/1990 | Beer et al. . | |

FOREIGN PATENT DOCUMENTS 0205073 of 1986 European Pat. Off. .

*Primary Examiner*—Stephen P. Garbe

*Attorney, Agent, or Firm*—Lee, Mann, Smith, McWilliams, Sweeney & Ohlson

[57] ABSTRACT

A flexible pouch package for fluid products including a composite bag having inner and outer package walls formed of flexible film folded over and sealed together about the outer edges thereof to define a chamber therein. The package may include an easy open feature.

13 Claims, 2 Drawing Sheets

FLEXIBLE PACKAGE WITH AN EASY OPEN ARRANGEMENT

BACKGROUND OF THE INVENTION

The present invention provides a flexible package for fluidic products and may include an easy open arrangement. Conventional packages for such products normally include components which are subject to flex cracks and rupture from the inside-out, immediately behind and adjacent the heat seals, and exterior surface fractures or cuts which destroy the barrier and/or cause product leakage. Additionally, most of these packages have a conventional tear notch which requires two hands to open the package and often results in spillage of the contents during opening of the package.

SUMMARY OF THE INVENTION

The present invention provides a flexible package forming a composite bag, with or without a handle, which includes inner and outer package walls formed from flexible film folded over and sealed about the edges thereof to define a chamber therein. An easy open arrangement can be included in the package. The package includes an aperture formed through the outer wall. An inner wall is disposed inside of the outer wall. The inner wall is sealed to the outer wall in the area around the aperture to prevent fluid from passing between the outer wall and inner wall and to strengthen the area. The easy open arrangement includes a pull tab disposed on the outer surface of the package overlying the aperture. A central portion of the pull tab is sealed to that portion of the inner wall disposed within the perimeter of the aperture. When the bag is held by one hand and the tab is pulled by the other hand, the lower portion of the tab pulls away from the outer surface of the bag. Due to the bond strength of the seal between the central portion of the pull tab and the inner wall this portion of the inner wall is ruptured and pulled through the aperture thereby exposing a pour hole in the package. Thus the package may be opened by holding it with one hand and removal of the tear tab by the other hand without any other support means. In addition, a portion of the pull tab may be removably adhered to the outer surface of the bag. Another portion of the pull tab may be permanently adhered to the outer surface of the bag. Then, after opening of the package, the pull tab remains attached to the outside surface of the package thereby conveniently leaving the tab attached to the package. This prevents litter and the need to discard the tab after opening the package.

DETAILED DESCRIPTION OF THE INVENTION

Figure 1:
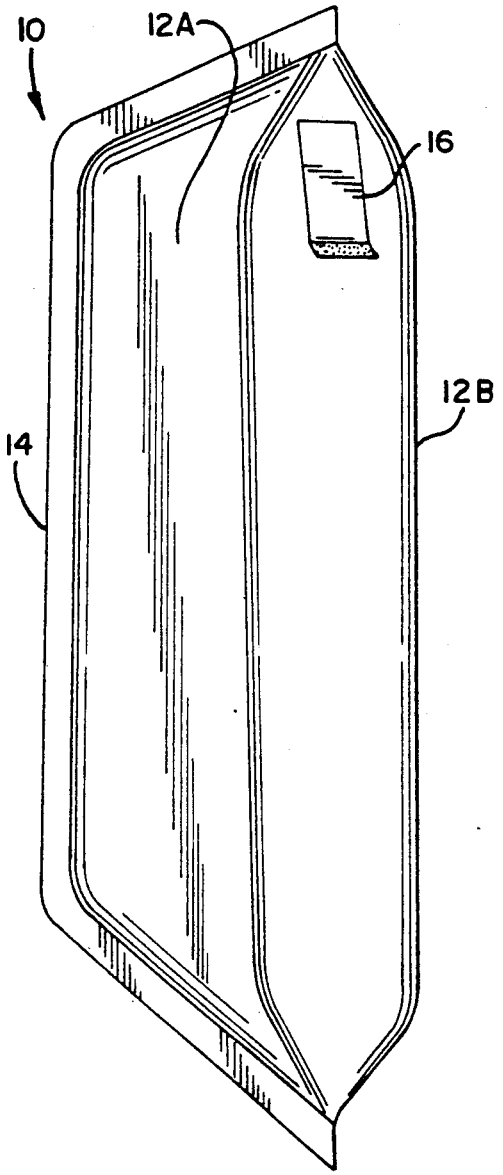
FIG. 1 is a perspective view of one embodiment of a package of the present invention.

Various embodiments of composite bag packages incorporating the features of the present invention are disclosed herein. Some of these packages include an easy open feature. One embodiment of a flexible package 10 is shown in FIG. 1. The package 10 includes a package surface 12A and a package surface 12B. A seal 14 is formed along three of the outer edges of the package. Although the package shown in FIGS. 1 and 2 has the seal 14 along the outermost edge, it is also possible to locate the seal in a vertical position running from top to bottom at the midpoint of the package surface 12B. This back-seal arrangement is referred to as a pillow pouch package. It is also possible, and within the scope of the present invention, to provide the composite bag with a handle at its upper end either molded integrally with the package or as an attachment. Such a handle arrangement provides the benefit of allowing the package user to grasp the handle in one hand and simply remove the pull tab with the other hand.

A mechanism for opening of the package 10 includes an easy open pull tab arrangement 16, which will be discussed in detail herein.

Figure 3:
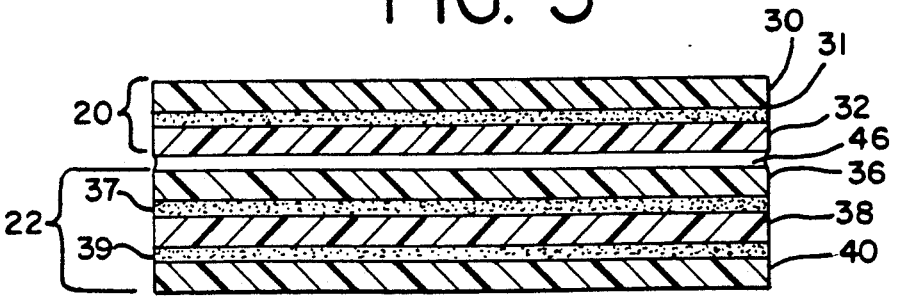
FIG. 3 is a cross-sectional view of two layers of film used to form one embodiment of a package of the present invention.
Figure 4:
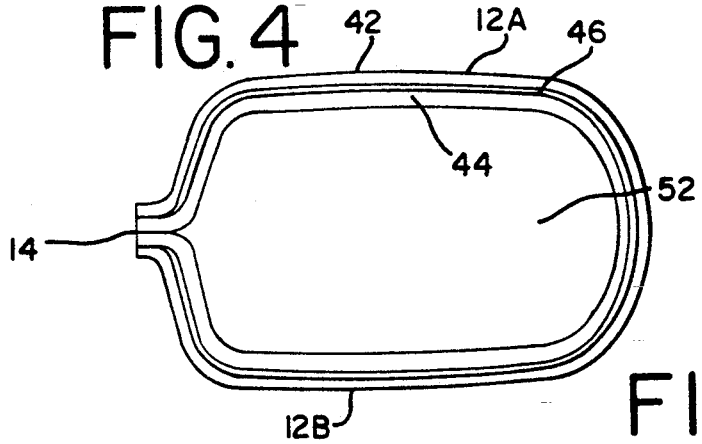
FIG. 4 is a cross-sectional view taken along line 4—4 of FIG. 2.

FIG. 3 illustrates two separate plastic films in sheet form which are used to form the composite bag shown in FIG. 4. The package 10 illustrated in FIG. 3 is formed from a first film laminate 20 and a second multilayer film 22 disposed adjacent and below the first film laminate 20. The first film laminate 20 is designed to act as the outer wall of the package 10 and to provide the main physical strength for the package. The second film 22 forms the inner package wall and may be either a laminate or a coextrusion, which is resistant to oils and moisture and provides high gas, vapor, and aroma barrier properties to the package. The outer wall and inner wall are each approximately 2.5 mils in thickness.

As seen in FIG. 3, the first film laminate 20 includes an outer layer 30 adhesive laminated to a heat seal compatible inner layer 32. The adhesive has been designated with the numeral 31 for illustrative purposes only. As a practical matter, this would not appear as a separate layer. The outer layer 30 is preferably a biaxially oriented nylon. It may be possible, however, to substitute biaxially oriented polypropylene or polyesters for the nylon or to form the outer layer from some combination of these constituents. The inner layer 32 is preferably linear low density polyethylene but other acceptable heat sealable materials can also be used. It is within the purview of the present invention to include layers in addition to the inner and outer layers 30, 32 disclosed herein.

The second film 22, shown in FIG. 3, is spaced from and disposed below film laminate 20 and includes a heat seal compatible layer 36 adhesive laminated to a middle layer 38 which is adhesive laminated to a heat seal compatible layer 40. The numbers 37 and 39 designate adhesive layers for illustrative purposes only. These adhesive layers would be coextruded as tie layers if the second film were coextruded, as opposed to adhesive laminated. The layer 36 and the layer 40 are formed of heat sealable polymeric material. One such material which has been found to perform satisfactorily is linear low density polyethylene. The middle layer 38 is preferably ethylene vinyl alcohol.

Figure 2:
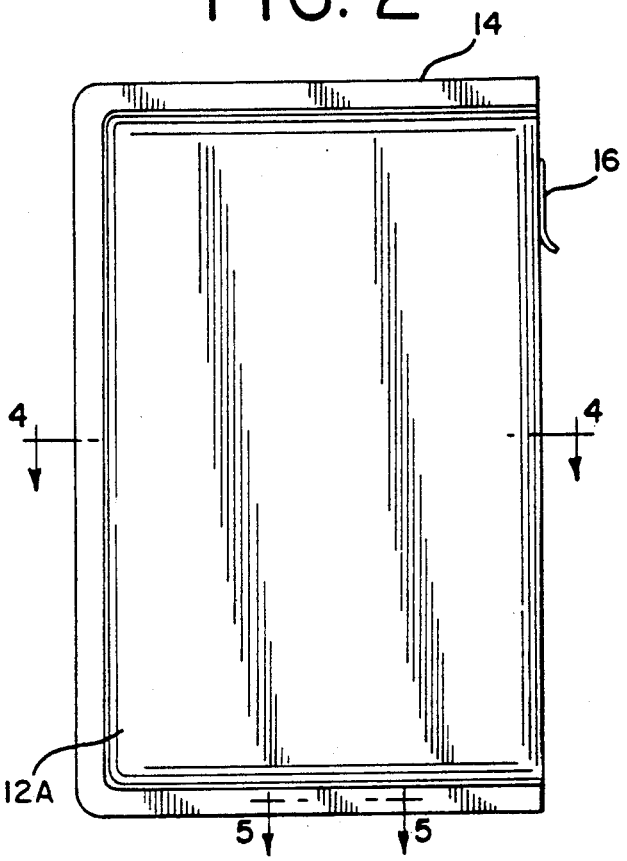
FIG. 2 is a front view of the package of FIG. 1.

The first and second films 20 and 22 are aligned prior to forming the package such that the inner layer 32 of the first film laminate 20 is adjacent and above the layer 36 of the second film 22. As best seen in FIG. 4, when the package is formed the first and second films 20 and 22 are folded over such that the layer 40 of the second film 22 is folded over on itself. The folded over films of this embodiment are sealed along the edges other than the fold edge, as illustrated in FIG. 2, to form a composite bag having an outer wall 42, which consists of the first film laminate 20 and an inner wall 44, which consists of the second film 22 with a gap or space 46 between inner and outer walls. This arrangement allows for slip of the inner wall 44 with respect to the outer wall 42 thereby reducing the possibility of rupture of package 10 due to the hydraulic effect of the package content thereby reducing product leakage.

As shown in FIG. 4, a chamber 52 is formed within the inner wall to contain product therein. Bags of this type are often used as containers for fluids, of many types, with or without particulates, including food products, such as jellies, preserves, salad oils, soups and milk and non-food fluids such as motor oils, paints, etc.

Figure 5:
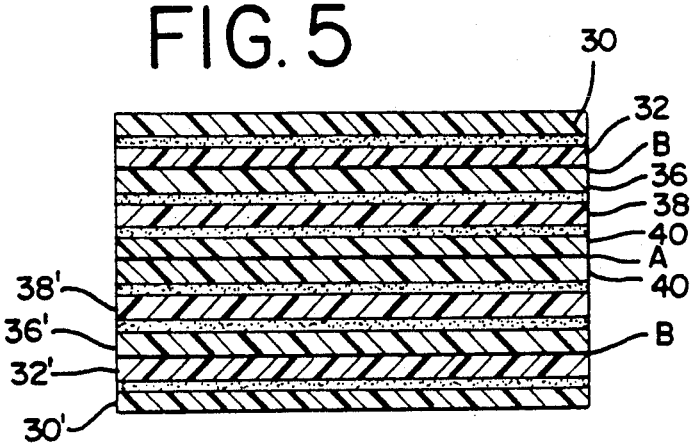
FIG. 5 is a cross-sectional view taken along line 5—5 of FIG. 2.

FIG. 5 illustrates a cross-section of the seal 14 which is generally formed by heat and pressure. This seal results in the inner layer 40 of the second film 22 being adhered to itself 40' at A, and the layer 32 being adhered to the layer 36 at B.

Figure 6:
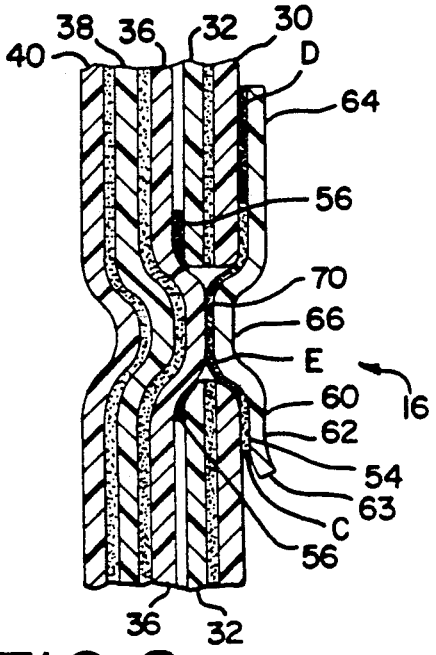
FIG. 6 is a partial cross-sectional view of that portion of the bag containing the easy open arrangement before opening of the package.
Figure 7:
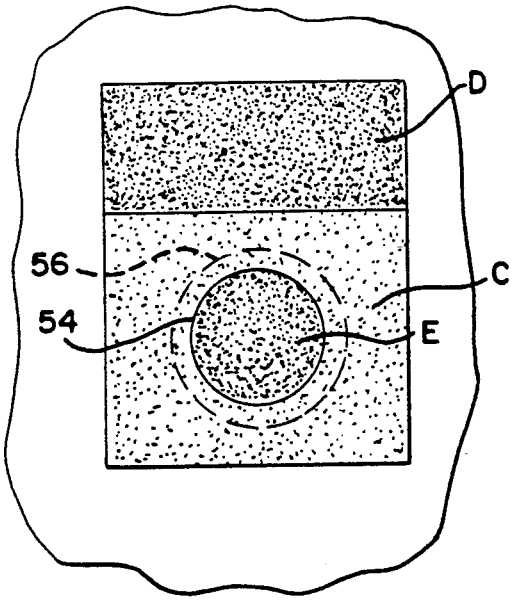
FIG. 7 is a side sectional view of a portion of the package of FIG. 2 showing a portion of the easy open arrangement prior to attachment of the tab.
Figure 8:
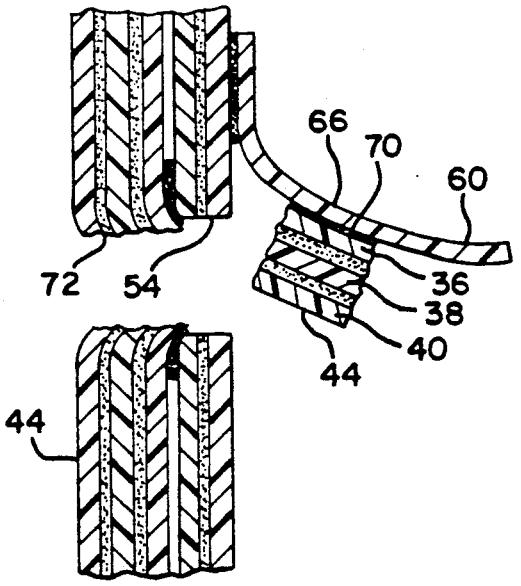
FIG. 8 is a partial cross-sectional view of the easy open arrangement shown in FIG. 6 after opening of the package.

Optionally, this package 10 can include an easy open arrangement 16 as best seen in FIGS. 6, 7 and 8. This arrangement includes a circular aperture 54, disposed through the outer wall to provide a pour hole in the package 10. A seal 56 is formed, preferably by heat, between the outer layer 36 of the second film 22 and the inner layer 32 of the first film laminate 20 around the aperture 54. This seal 56 is shown in dotted lines in FIG. 7. This seal 56 prevents the contents of package 10 from seeping between the outer wall 42 and the inner wall 44 when the product is poured from the bag and additionally strengthens the area around the aperture 54 to allow for a clean tear out of that portion of the inner wall 44 disposed within the area of the aperture 54 when the package 10 is opened.

The easy open arrangement further includes a pull tab 60, having a first portion 62, removably adhered to the outer surface of the outer wall 42 at C by an adhesive. The tab 60 also includes a tip 63 which is curled away from the package wall so that it can be easily grasped when opening is desired.

A second portion 64 of the tab 60 is permanently adhered to the outer surface of the outer wall 42 by adhesive at D. A central portion 66 of the tab 60 is sealed to that portion of the layer 36 located within the perimeter of the aperture 54, at E, to form a seal 70. It is important that the strength of seal 70 exceeds the strength of the bond between layers 36 and 38 and between layers 38 and 40 to insure a clean rupture of the inner wall or membrane as opposed to delamination between these layers.

To achieve the proper adherence of the pull tab 60, the pull tab 60 can be covered over its entire area with an extremely aggressive pressure sensitive adhesive such as the adhesive identified as XD2621 sold by MACtac of Stow, Ohio. As shown in FIG. 7, the outer surface of the outer wall 42 can then include a layer of adhesion retarding material disposed in area C such that the first portion 64 of the tab 60 is removably adhered to the outer surface of the outer wall 42 while the second portion 62 of the tab 60 is permanently adhered to the outer surface of the outer wall 42 at D and the central portion 66 of the tab 60 is sealed to that portion of the layer 36 within the perimeter of the aperture 54 at E, to form the seal 70. Alternatively, the seal 70 can be formed from a heat seal between the central portion 66 of the tab 60 and the layer 36 within the perimeter of the aperture 54.

Although the preferred easy-open arrangement includes a portion of the tab permanently adhered to the outer surface of the package and another portion removably adhered to the outer surface, it is within the purview of the invention to use a tab which has its only attachment to the package through the seal 70.

In use, the package 10, with or without a handle and of three side seal or pillow style construction, is held in one hand and the pull tab 60 is grasped at tip 63 and pulled upwardly. As shown in FIG. 8, as the tab 60 is pulled, the inner wall 44 is ruptured in the area of the aperture 54, interior to the seal 56, to expose a pour hole 72. The portion of the inner wall adhered to the central portion 66 of the tab 60, layers 40, 38 and 36, is pulled through the aperture 54 and out of the chamber 52 to provide for pouring of the contents from the package 10. The seal 56 protects against fluid seeping between the inner and outer walls.

In an alternative embodiment, not shown, the outer package wall is made from the same primary substrate as that disclosed in the embodiment previously described but with increased basis weight and with the addition of layers to provide the barrier properties of the previously described inner wall. One example of such a construction is an outer layer of biaxially oriented polyamide (nylon), approximately one mil thick, followed by a layer of adhesive, with a layer of low density polyethylene, approximately one-half mil thick, extrusion laminated to a coextrusion, approximately three mils thick, of linear low density polyethylene, a tie layer, a layer of ethylene vinyl alcohol, a tie layer and a layer of linear low density polyethylene. In this embodiment however a patch or membrane forms the inner package wall. The patch or membrane is disposed within the chamber 52 overlying the aperture. The membrane is formed of at least one layer of polyethylene. Preferably the membrane is formed of the same three layers of material as previously disclosed for the inner wall.

A seal similar to the seal 56 is formed between the membrane and the inner surface of the first package wall around the aperture. A pull tab, similar to the one previously discussed herein is disposed on the outer surface of the package overlying the aperture. A seal is formed between the central portion of the tab and the membrane, within the perimeter of the aperture, as discussed previously.

In use, the package 10 is firmly grasped in one hand and the pull tab is grasped and pulled upward and outward. The action of the pull tab causes rupture of the membrane in the area of the aperture interior to the seal to provide a pour hole for the pouring of the contents from the package 10.

Various embodiments of the invention have been particularly shown and described in connection with the illustrated embodiments of the invention, however, it must be understood that these particular arrangements merely illustrate and that the invention is to be given its fullest interpretation within the terms of the appended claims.

We claim:

1. A flexible package arrangement forming a composite bag including an outer wall formed by a first flexible film laminate said first film laminate including a plurality of layers with at least an outer layer of biaxially oriented polyamide adhered to an inner layer of heat sealable material, said outer wall adapted to provide the main physical strength for the bag; an inner wall formed by a second flexible film disposed interior to and positioned adjacent said outer wall, said second film including at least an outer layer of polymeric material, heat seal compatible with said inner layer of said outer wall, an inner layer of polymeric material, heat seal compatible with itself and a middle layer of ethylene vinyl alcohol, said inner wall being resistant to oils and moisture and providing high gas, vapor and aroma barrier properties to thereby protect the integrity of product disposed within said package, said outer wall and said inner wall folded over at one side and aligned such that said inner layer of said inner wall is folded over on itself; and a seal formed along at least one edge of said bag sealing said inner layer of said inner wall to itself and sealing said outer layer of said inner wall to said inner layer of said outer wall thereby forming an interior chamber for product to be contained therein and forming a composite bag with inner and outer walls adhered to each other along said seal but freely slidable with respect to each other at other locations.

2. A flexible package as in claim 1 including an aperture formed through said outer wall and a first seal formed around said aperture between said inner layer of said outer wall and said outer layer of said inner wall so as to preclude product being poured from said package from flowing between said inner and outer bag walls.

3. A flexible package arrangement as in claim 2 including a pull tab disposed external to and adjacent said outer wall overlying said aperture, and a second seal formed between a central portion of said pull tab and said outer layer of said inner package wall within the perimeter of said aperture, whereby pulling of said pull tab causes a rupture of said inner wall, in the area of said aperture interior to said first seal, such that the portion of said inner wall adhered to said pull tab is pulled through said aperture and out of said chamber to thereby effect an easy open pour hole for pouring of the contents of said package.

4. A flexible package as in claim 3 including means for removably adhering a first portion of said tab to said outer surface of said package, said first portion of said tab overlying said aperture in a sealed position.

5. A flexible package as in claim 3 including means for permanently adhering a second portion of said tab to said outer surface of said package so as to retain said tab with said package in both a sealed and unsealed position.

6. A flexible package arrangement as in claim 1 in which said inner layer of said outer package wall is formed of linear low density polyethylene.

7. A flexible package arrangement as in claim 1 in which said outer layer of said inner package wall is formed of linear low density polyethylene.

8. A flexible package arrangement as in claim 1 in which said inner layer of said inner package wall is formed of linear low density polyethylene.

9. A flexible package as in claim 1 wherein said inner layer of said outer package wall is a layer of heat sealable polymeric material.

10. An easy open flexible package arrangement forming a composite bag comprising a first flexible film forming an outer package wall; an aperture formed through said outer package wall; a second flexible film forming an inner package wall interior to and adjacent said first flexible film overlying said aperture, said inner wall being resistant to oils and moisture and providing high gas, vapor and aroma barrier properties to thereby protect the integrity of the product disposed within said package, said outer wall and said inner wall folded over at one side; a first seal formed around said aperture, between said inner package wall and said outer package wall, so as to preclude product being poured from said package from flowing between said first and second films; a second seal formed along at least one edge of said bag sealing said inner wall to itself and sealing said inner wall to said outer wall, thereby forming an interior chamber for product to be contained therein and forming a composite bag with said inner and said outer walls adhered to each other along said second seal but freely slidable with respect to each other at other locations; a pull tab disposed external to and adjacent said outer package wall, said tab including a first portion adapted to overlie and cover said aperture; a third seal formed between said first portion of said tab and said second film, within the perimeter of said aperture, whereby pulling of said pull tab causes a rupture of said second film in the area of said aperture, interior to said first seal, such that the portion of said second film adhered to said pull tab is pulled through said aperture and out of said chamber to thereby effect an easy open pour hole for pouring of the contents of said package.

11. An easy open flexible package as in claim 10 including means for removably adhering said first portion of said tab to said outer package wall.

12. An easy open flexible package as in claim 10 including means for permanently adhering a second portion of said tab to said outer package wall so as to retain said tab with said package in both a sealed and an unsealed condition.

13. An easy open flexible package as in claim 10 in which an inner layer of said outer package wall and an outer layer of said second flexible film are formed of heat sealable polymeric material.

* * * * *